United States Patent [19]

Samsel, Jr.

[11] Patent Number: 4,513,969

[45] Date of Patent: Apr. 30, 1985

[54] AUTOMATIC CARD SHUFFLER

[75] Inventor: J. Edward Samsel, Jr., Southampton, Pa.

[73] Assignee: American Gaming Industries, Inc., Philadelphia, Pa.

[21] Appl. No.: 420,514

[22] Filed: Sep. 20, 1982

[51] Int. Cl.[3] ..... A63F 1/12

[52] U.S. Cl. ..... 273/149 R

[58] Field of Search ..... 271/3.1, 9; 273/149 R, 273/138 A

[56] References Cited

U.S. PATENT DOCUMENTS

| | | | |
|---|---|---|---|
| 1,998,690 | 4/1935 | Shepherd et al. | 273/149 R |
| 2,747,877 | 5/1956 | Howard | 273/149 R |
| 2,755,090 | 7/1956 | Aldrich | 273/149 R |
| 2,815,214 | 12/1957 | Hall | 273/149 R |
| 3,588,116 | 6/1971 | Miura | 273/149 R |
| 3,929,339 | 12/1975 | Mattioli | 273/149 R |
| 4,037,845 | 7/1977 | Hooker | 273/138 A |
| 4,095,795 | 6/1978 | Saxton et al. | 273/138 A |
| 4,310,160 | 1/1982 | Willette et al. | 273/149 R |

*Primary Examiner*—Richard C. Pinkham

*Assistant Examiner*—Leó P. Picard

[57] ABSTRACT

An automatic card shuffler comprising a housing with at least two wells to receive two reserve stacks of playing cards to be intermixed and presented to a dealer one at a time. First extractor is provided to select, remove and intermix in a random sequence the bottommost card from each stack and to deliver the intermixed cards to a storage compartment or reservoir. A second extractor is provided to sequentially remove the bottommost card from the storage compartment or reservoir and to deliver it to a shoe having a dispensing compartment from which the dealer may take the card for presentation to the players. A sensor is used for determining the approximate number of cards in at least one of the wells and for determining the presence or absence of a card from the dispensing compartment. An electronic controller comprising a clock oscillator driving a binary counter and decoder is provided for randomly actuating the first extractor to randomly select and remove cards from the wells and thereby randomly intermix the cards as they are delivered to the storage compartment or reservoir.

23 Claims, 16 Drawing Figures

FIG. 8
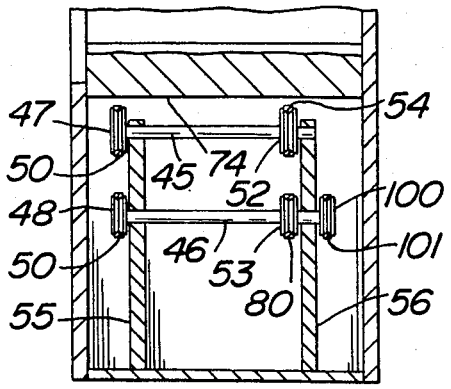
FIG. 9
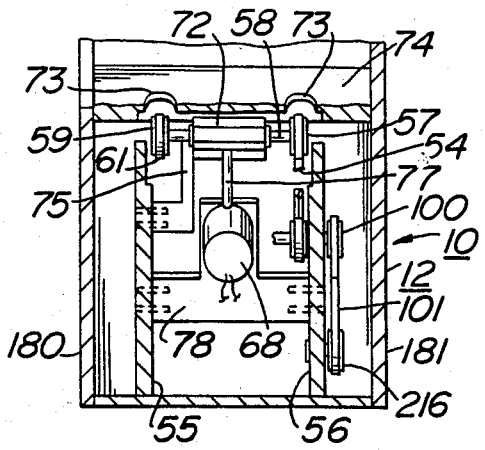
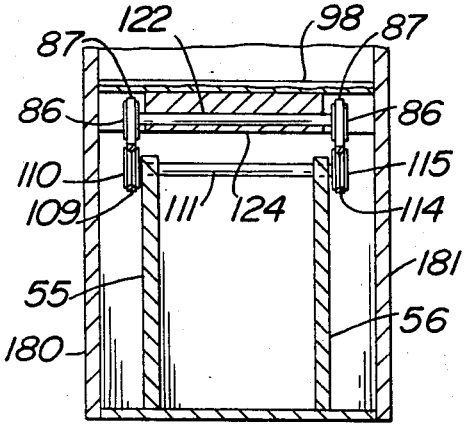
FIG. 10
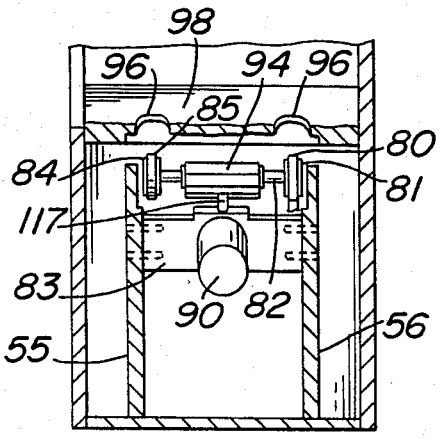
FIG. 11
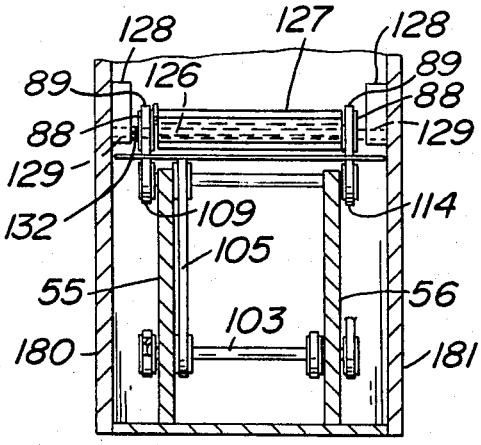
FIG. 12

65
68
SOLENOID
90
SOLENOID
152
~~150~~
SOLENOID
324
SOLENOID DRIVER
286
SOLENOID DRIVER
292
SOLENOID DRIVER
322
"ON" DWELL TIMER
284
"ON" DWELL TIMER
290
"ON" DWELL TIMER
"OFF" DWELL TIMER
INHIBIT
306
282
280
300
321
320
316
318
ONE SHOT
308
DECODER
INHIBIT
304
314
310
COUNTER
312
298
302
259
CLOCK
DWELL F
278
INITIAL LOAD TIMER
RESET
OUTPUT
288
296
294
ONE SHOT
RESET
F
F
276
ON
OFF
262
252
PHOTO SENSOR
PHOTO SENSOR
250

AUTOMATIC CARD SHUFFLER

BACKGROUND OF THE INVENTION

This invention relates generally to automatic card shuffling devices and, in particular, to devices for continuously shuffling a number of decks of cards.

In gambling casinos certain card games are played with several decks of cards used during the playing of the game. The large number of cards makes it difficult to quickly, manually shuffle the cards and the speed of the game is largely determined by the dexterity of the dealer. It has been heretofore proposed to provide automatic card shuffling devices to reduce the time required to shuffle and deal the cards in such games, so that the number of hands played per hour may be increased.

One prior art automatic shuffling device is shown in U.S. Pat. No. 4,310,160 issued to Leo Willette and Betty Willette. In this prior patent one card at a time is removed from the bottom of each of two stacks of cards in a predetermined alternating sequence. There is no arrangement provided in this prior patent for randomly selecting the cards from the two stacks of cards. In this prior patent one card must at all times be taken from each stack in an alternating sequence.

It is more desirable to provide an automatic card shuffling device with automatic means for randomly selecting one or more cards from the two stacks in a random sequence rather than in a fixed alternating sequence between the two stacks.

BRIEF SUMMARY OF THE INVENTION

The automatic shuffling device for playing cards of this invention comprises a housing defining at least two wells for receiving two stacks of playing cards and first electrically operated means to extract cards from the wells. The extracted cards are received by transport means to move them forward toward the dealer. An electrical controller randomly actuates the first power means so as to randomly select cards as they are delivered to the transport means. The housing further defines a storage compartment to receive intermixed cards from the wells. Also, second electrically operated means extracts cards from the storage compartment one at a time and delivers them to a dispensing compartment from which the dealer may remove them.

The electrically operated means to extract the cards are moved into engagement with the bottommost cards in the stacks and out of engagement therewith.

It is an object of this invention to provide an automatic card shuffler in which the mixing of the cards is random and the order of the dealt cards is virtually unpredictable by the card players.

The foregoing and other objects of this invention, the principles of the invention and the best modes in which I have contemplated applying such principles will more fully appear from the following description and accompanying drawings in illustration thereof.

BRIEF DESCRIPTION OF THE VIEWS

Figure 6:
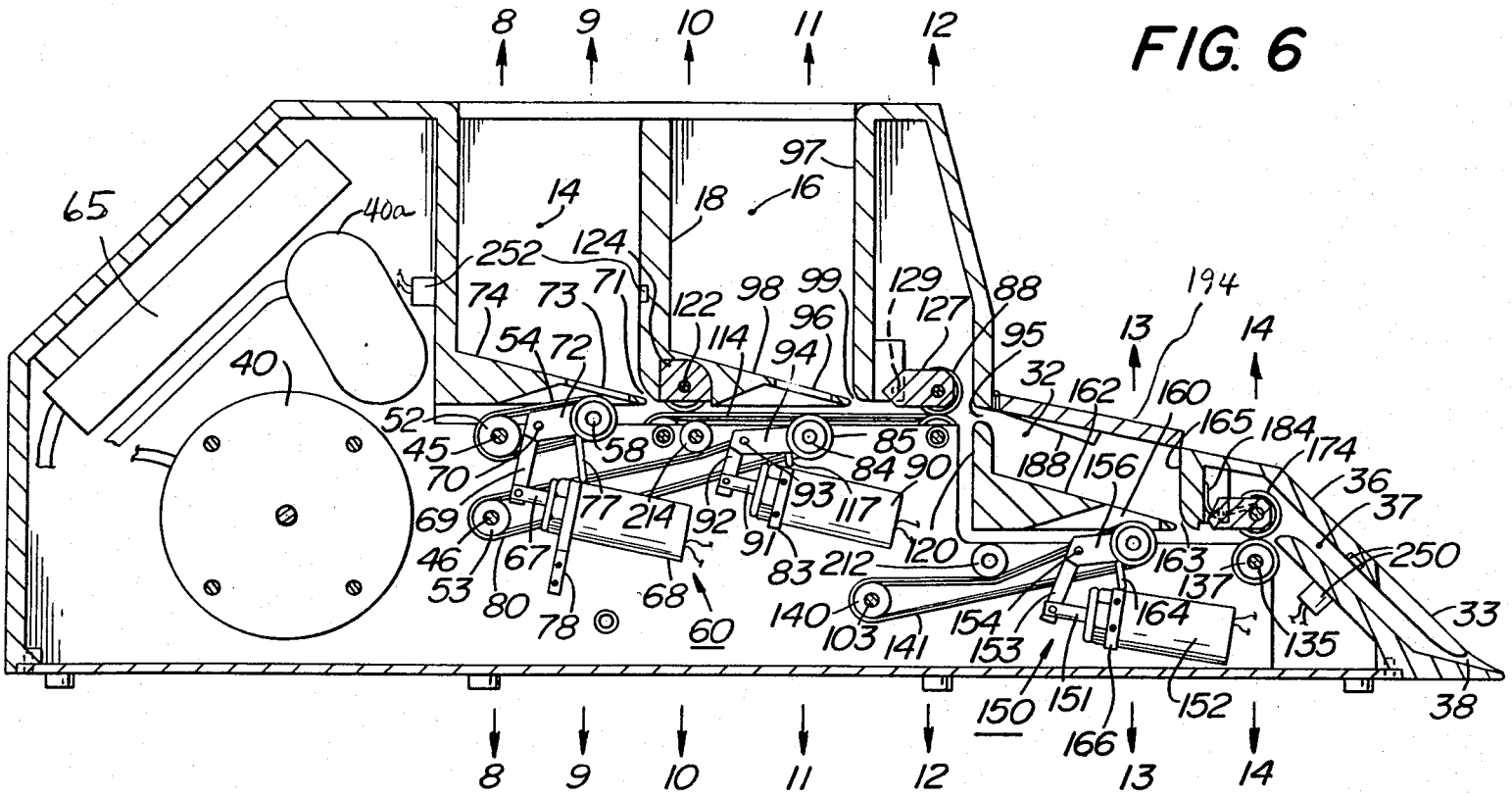
FIG. 6 is a cross-sectional view taken along the line 6—6 in FIG. 5 showing some of the internal parts in elevation.
Figure 15:
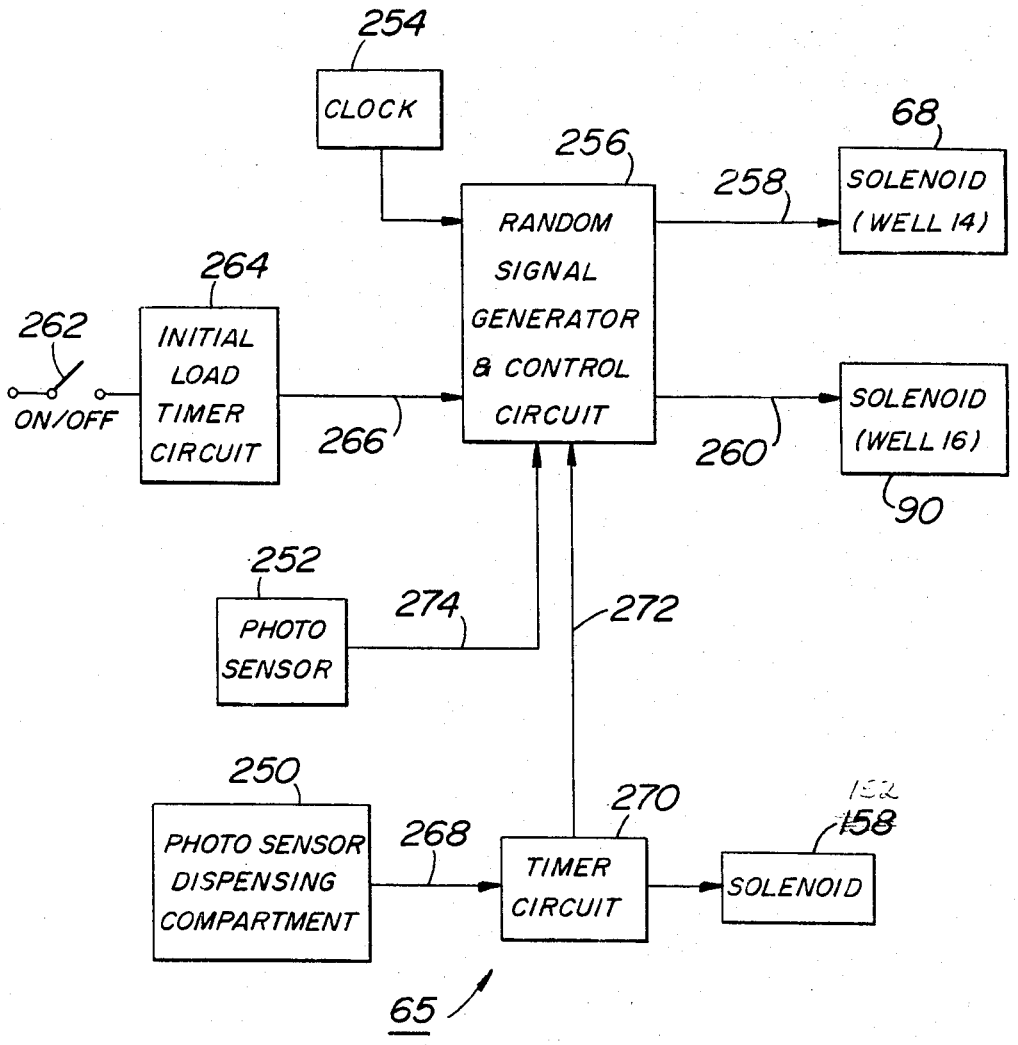
Figure 16:
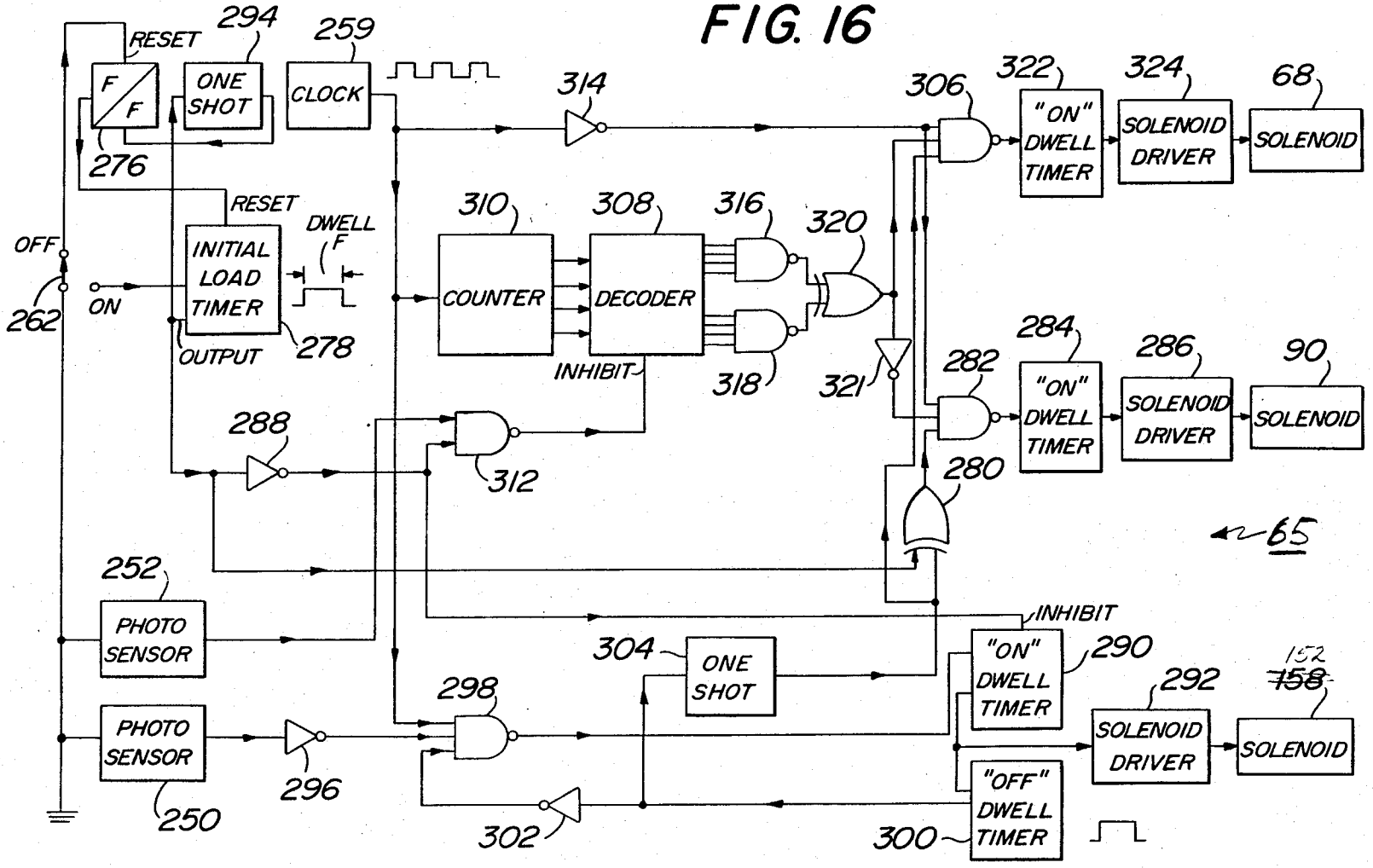

FIGS. 8 through 14 are partly cross-sectional and partly elevational views taken along the planes indicated by the lines 8—8, 9—9, 10—10, 11—11, 12—12, 13—13 and 14—14 in FIG. 6, but omitting those parts not in the indicated planes;

FIG. 15 is a block diagram schematic view of the electrical control circuitry utilized in the present invention; and FIG. 16 is a schematic diagram, partially in block diagram form, of the preferred embodiment of the electrical circuitry utilized in the present invention.

DESCRIPTION OF THE PREFERRED EMBODIMENT

Figure 1:
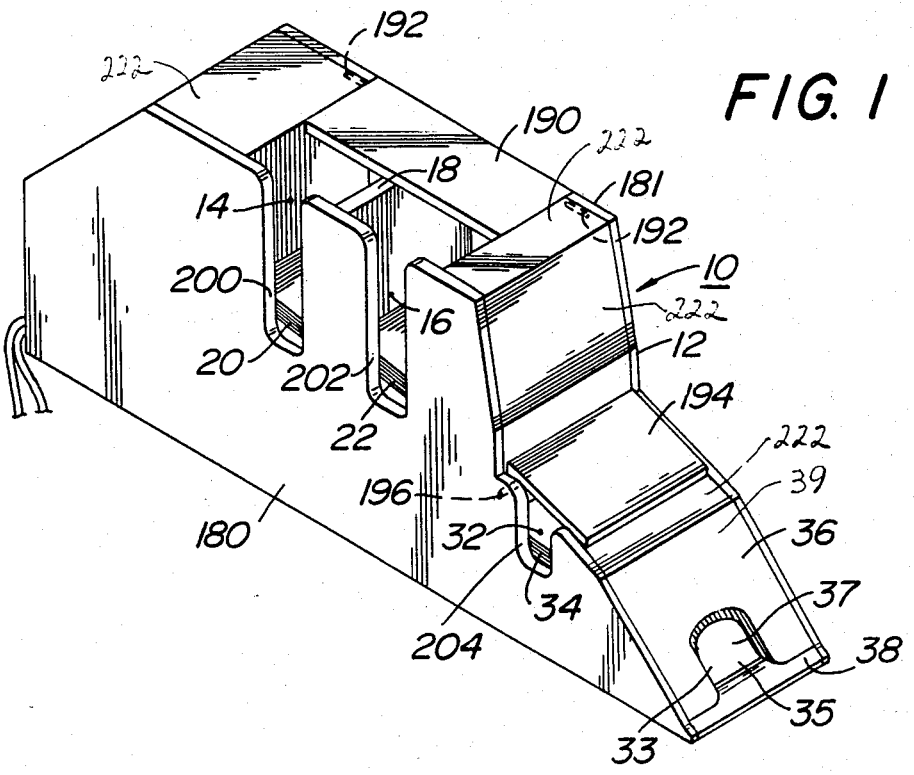
FIG. 1 is a front and top perspective view of the automatic card shuffler of this invention.

Referring to the drawings, and in particular to FIG. 1, an automatic card shuffler 10 is shown comprising a housing 12 preferably formed of a suitable plastic material. The housing 12 forms two vertical wells, a rear well 14 and a front well 16, separated from each other by a vertical wall 18 to receive two reserve stacks of playing cards 20 and 22, respectively.

The bottommost playing cards from the reserve stacks 20 and 22 (FIG. 2) are randomly selected and intermixed by a mechanism 30, hereinafter described in further detail, and transported to the top of the storage compartment or reservoir 32 to form a third stack or reservoir of cards 34. The bottommost playing card from the reservoir stack of cards 34 is delivered by the mechanism 30 to a shoe 36 forming a dispensing compartment 37 from which the dealer may take the card 35 through a thumb hole 33 and a slot 38 (FIG. 2) for presentation to the players. The thumb hole 33 is formed in a cover 39 for the dispensing compartment 37.

Figure 2:
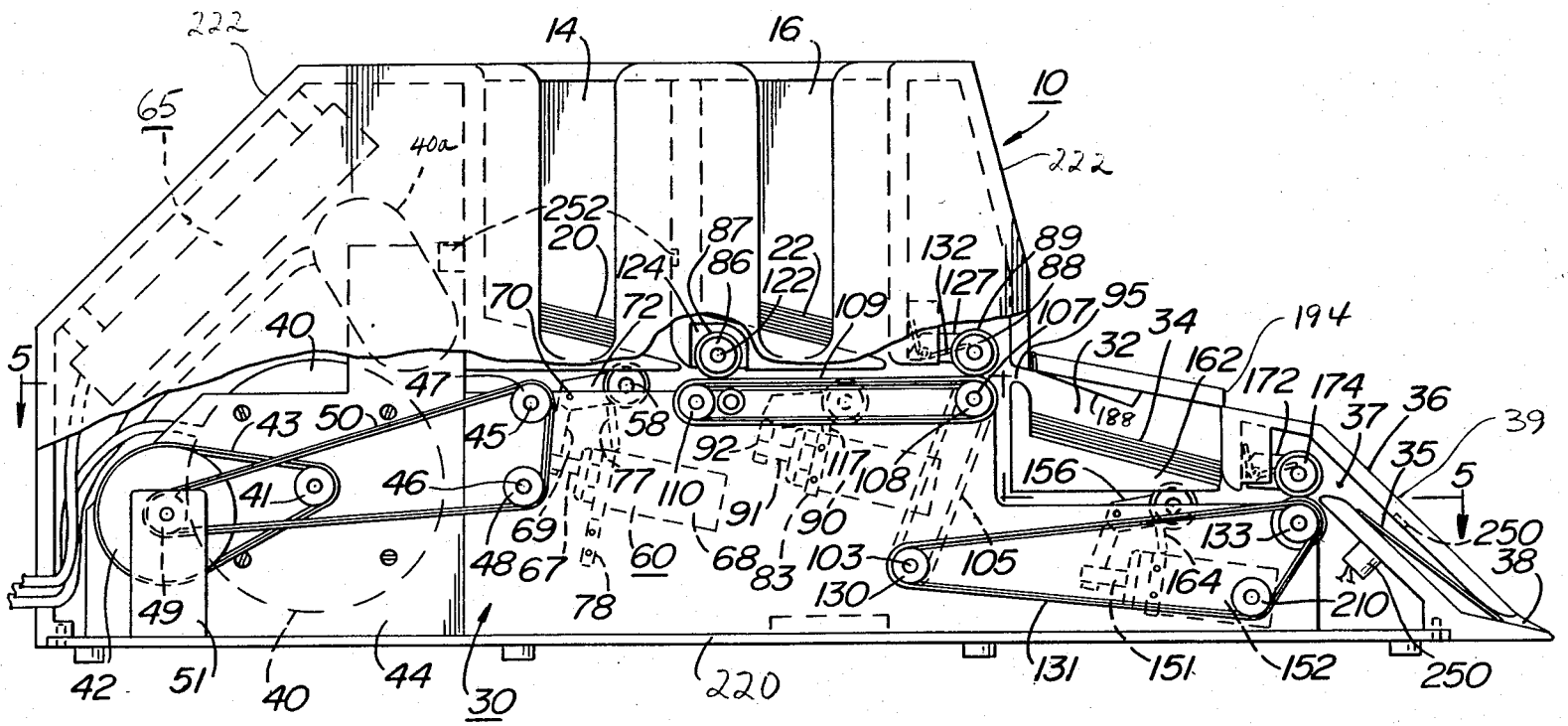
FIG. 2 is a front elevation view of the shuffler shown in FIG. 1 with the front wall partially cut away to show some of the internal parts.
Figure 3:
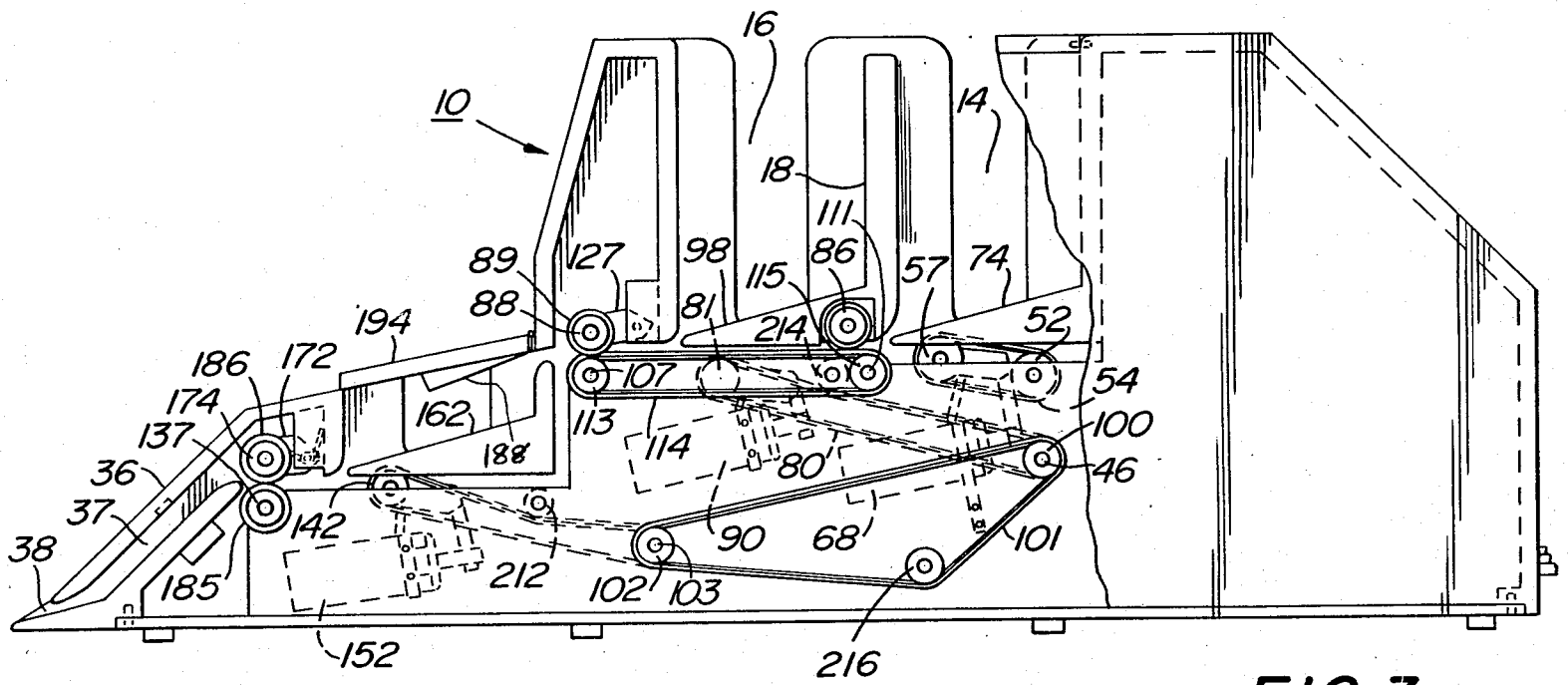
FIG. 3 is a back elevation view of the shuffler shown in FIGS. 1 and 2 with the back wall partially cut away to show some of the internal parts.
Figure 4:
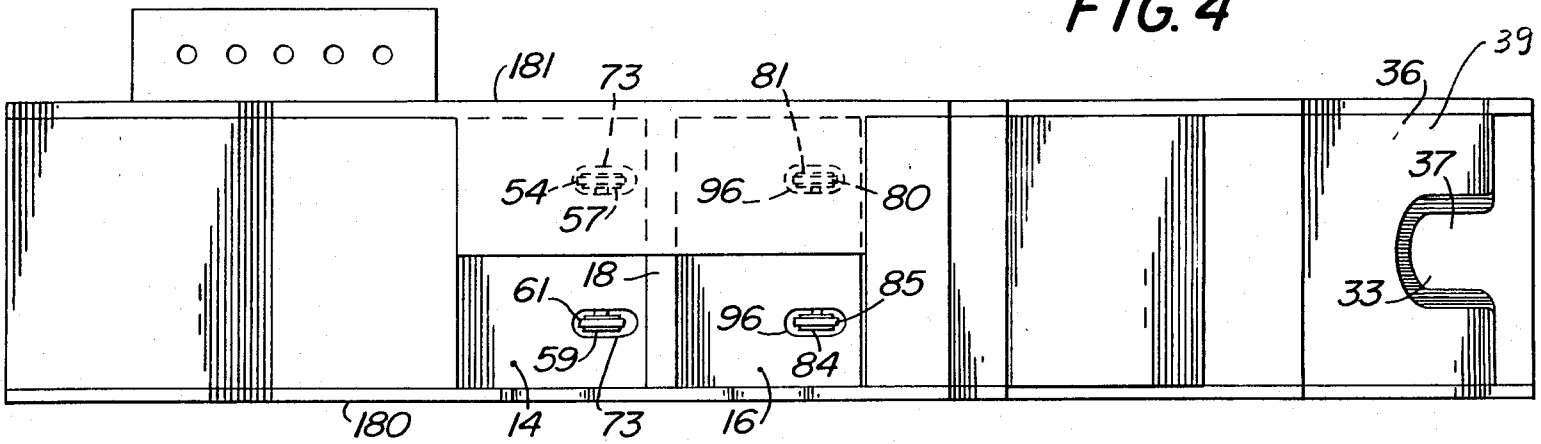
FIG. 4 is a top elevation view of the shuffler shown in FIGS. 1 to 3.
Figure 5:
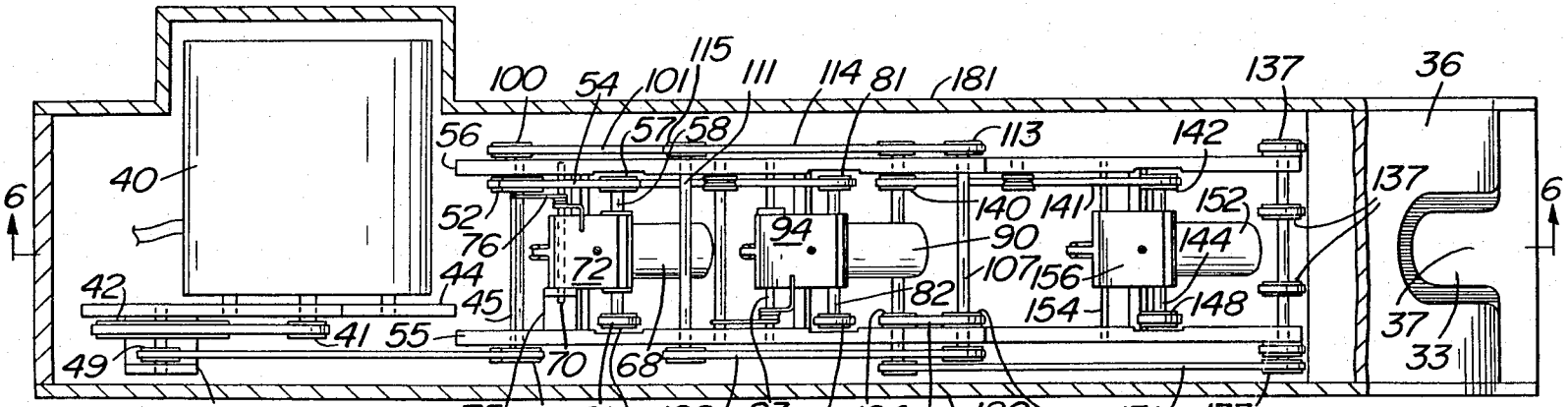
FIG. 5 is a cross-sectional view taken along the line 5—5 in FIG. 2 showing some of the internal parts in elevation.
Figure 7:
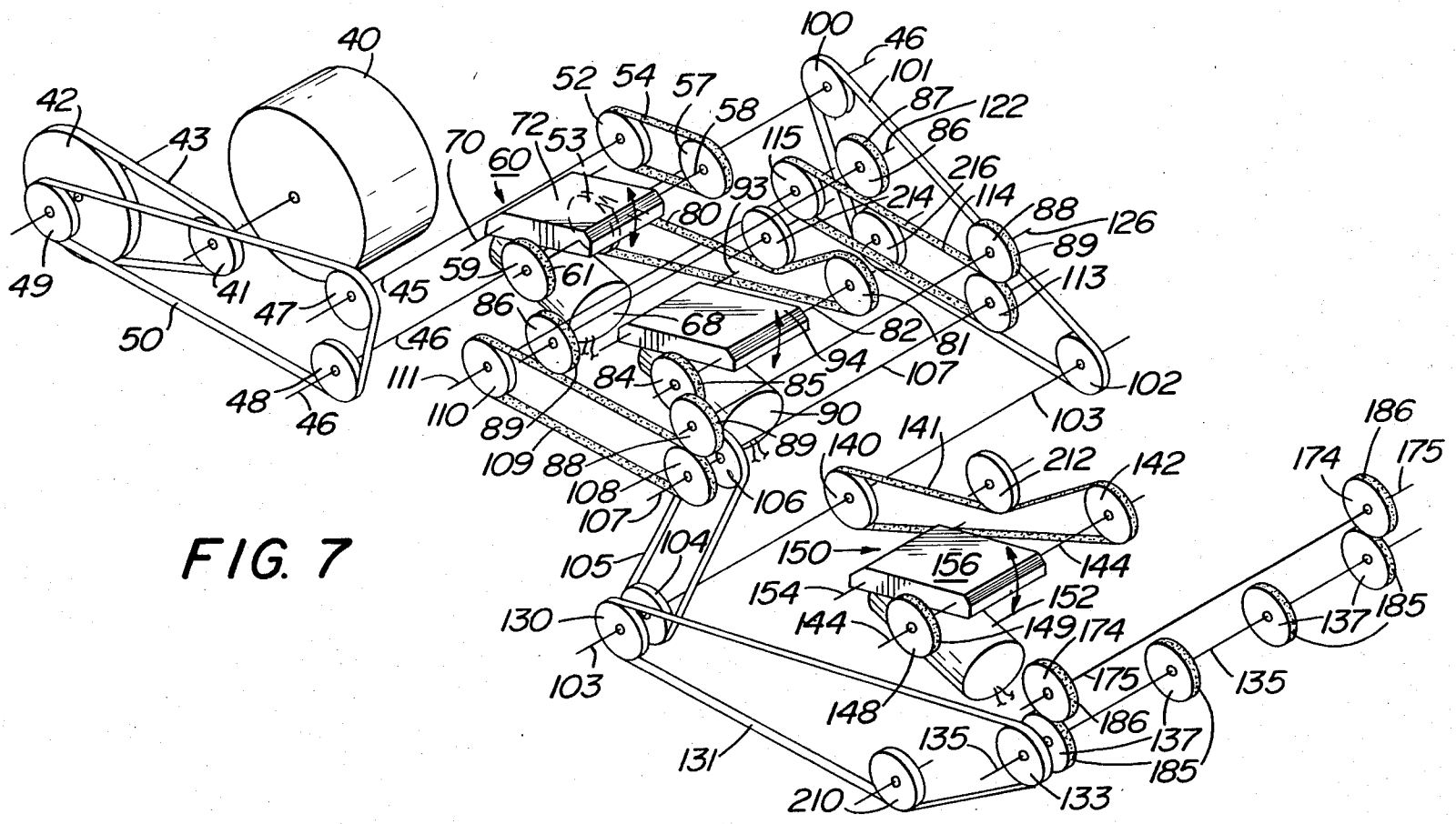
FIG. 7 is an exploded, diagrammatic view of the internal mechanism of this shuffler.

As diagrammatically shown in FIG. 7 and as further shown in FIGS. 2, 3 and 5, the mechanism 30 comprises an electrical motor 40 (including a capacitor 40*a*) whose speed is reduced by pulleys 41 and 42 and a belt 43 and whose power is delivered to upper and lower shafts 45 and 46, respectively, by further pulleys 47, 48 and 49 and a belt 50. The motor 40 is mounted on a front wall 44 (FIG. 5) and the motor shaft (on which pulley 41 is mounted) extends therethrough. The further shaft for the pulleys 42 and 49 is mounted at one end on the wall 44 and at the other end on the support wall 51, as shown in FIGS. 2 and 5. The pulleys 47 and 48 are mounted on shafts 45 and 46 so that the pulleys 41, 42, 47, 48 and 49 and belts 43 and 50 are essentially in a front plane of the shuffler 10, as shown in FIGS. 5 and 7. The shafts 45 and 46 transfer the power of the motor 40 to the pulleys 52 and 53 which are rotatable with the shafts 45 and 46, respectively, at the ends of the shafts 45 and 46 opposite pulleys 47 and 48 so that the pulleys 52 and 53 are in a back plane, as shown in FIGS. 5 and 7, adjacent to and on the inside of a support wall 56. The opposite ends of the shafts 45 and 46 are carried by the spaced support walls 55 and 56, as shown in FIG. 5. The pulley 52 is connected by a belt 54 to a further pulley 57 which is carried by and rotates a shaft 58 on which is mounted at the other end of the shaft 58 a wheel 59 on which is mounted a circular ring 61.

When it is desired to remove the bottommost card from the reserve stack 20 in the well 14, a solenoid linkage mechanism 60 is energized by an electronic controller 65 to retract the solenoid shaft 67 (FIGS. 2, 6 and 7) of a solenoid 68, causing a link 69 to pivot about a fixed pintle 70 (FIG. 5), thereby pivoting up and raising a plate 72. The shaft 58 extends through and is journaled in the plate 72, so that the raising of the plate 72 also raises the pulley 57 and the wheel 59, causing them to enter into and extend through correspondingly spaced slots 73 in the sloping bottom wall 74 of the well 14, bringing the belt 54 and the ring 61 into contact with the lowermost card in the stack 20 to eject it from the well 14 and propel it forward or to the right, as viewed in FIGS. 2 and 6, into and through the narrow slit 71 formed by the right hand, leading edge of the bottom wall 74 and the bottom of the wall 18.

As the card passes through the slit 71 it is received upon transport belts 109 (FIG. 2) and 114 (FIG. 6) and between the belts 109 and 114 and the two spaced idler wheels 86 and further propelled forward, to the right in FIG. 2, until it passes under two further spaced idler wheels 88, then into and through the slit 95 to be deposited into the storage compartment 32. The idler wheels 86 and 88 carry suitable rings 87 and 89, respectively, to better engage the cards.

The slit 95 is formed in the left wall 120 (FIGS. 2 and 6) of the storage compartment 32 and is aligned with the path of travel of a card upon the belts 109 and 114, but no card is shown on the belts 109 and 114 in FIGS. 2 and 6.

The pintle 70 for the pivotal plate 72 is supported at one end in the wall 56 and at the other by a bracket 75 (FIG. 5) which is in turn fastened to and extends from the wall 55. The pintle 70 carries a coil spring 76 having one leg biased against the shaft 45 and the other leg biased against the plate 72 for biasing the plate 72 clockwise, as viewed in FIG. 6, away from the slots 73. The plate 72 carries a stop leg 77 (FIG. 6) which abuts against the solenoid 68 to limit clockwise rotation of the plate 72. Also, the solenoid 68 is secured to a bridge plate 78 which is in turn secured to the walls 55 and 56, as shown in FIGS. 6 and 9.

From the shaft 46, power is taken through the pulley 53 by a belt 80 to rotate a further pulley 81 mounted on and rotating a shaft 82 on which is mounted another wheel 84 carrying a ring 85. When it is desired to remove the bottommost card from the stack 22 in the front well 16, a solenoid 90 is energized by the controller 65, the solenoid 90 being supported by a bridging plate 83 (FIG. 11). Energization of the solenoid 90 retracts the solenoid shaft 91, pivoting the link 92 about the pintle 93 (FIGS. 2, 5 and 6) to pivot and raise the plate 94, thereby to raise the pulley 81 and the wheel 84, because the shaft 82 is journaled in and carried by the plate 94, through the slots 96 (formed in the bottom wall 98 of the well 16) and to bring the belt 80 and the ring 85 into contact with the bottommost card in the stack 22 of front well 16, so as to eject it forward or to the right, as viewed in FIG. 2. The card so ejected from the front well 16 enters the slit 99 formed between the leading edge of the bottom wall 98 and the vertical wall 97 and upon exiting therefrom engages the transport belts 109 and 114 and is moved forward until it passes under the idler wheels 88 to be delivered through the slit 95 into the compartment 32. Clockwise pivoting of the plate 94 is limited by the stop 117 which abuts the bridging plate 83.

The lower shaft 46, as viewed in FIG. 7, extends to the rear, and, as viewed in FIG. 5, beyond the supporting wall 56 to receive a pulley 100 which is mounted thereon and is rotatable therewith. The pulley 100 carries a belt 101 which transfers power from the pulley 100 to the pulley 102 which is mounted on and rotatable with the shaft 103. The shaft 103 extends forward, as viewed in FIG. 7, and carries a further pulley 104. The pulley 104 carries a belt 105 which extends upwardly to an upper pulley 106 and is mounted on and rotates with a shaft 107, the shaft 107 being rotatably carried by the walls 55 and 56. The shaft 107 extends through the wall 55 and also carries a pulley 108 rotatable therewith and about which is placed the transport belt 109 which extends to a pulley 110 mounted on and rotatable with the end of a shaft 111. The other end of the shaft 107 rotatable carries a pulley 113 about which is placed the transport belt 114 which extends to a pulley 115 which is rotatable with and mounted on the end of the shaft 111, as shown in FIGS. 5 and 7. The opposite ends of shafts 103 and 107 are rotatably mounted on the spaced walls 55 and 56.

The shaft 103 also rotatable carries a pulley 140 about which is a belt 141 for transferring power to a pulley 142 mounted on a shaft 144. The shaft 144 carries a wheel 148 about which is a ring 149, as shown in FIGS. 5 and 7.

When it is desired to remove the bottommost card from the storage compartment 32, a solenoid linkage mechanism 150 is energized by the controller 65 to retract the solenoid shaft 151 (FIGS. 2, 6 and 7) of a solenoid 152, causing a link 153 to pivot about a fixed pintle 154 (FIG. 6), thereby pivoting and raising a plate 156. The shaft 144 extends through and is journaled in the plate 156, so that the raising of the plate 156 also raises the pulley 142 and the wheel 148, causing them to enter into and through a correspondingly elongated slot 160 (FIG. 13) in the bottom wall 162 of the storage compartment 32, bringing the belt 141 and the ring 149 into contact with the bottommost card in the compartment 32 and propelling it forward to the right, as viewed in FIGS. 2 and 6, ejecting it from the compartment 32. The card so ejected from the compartment 32 enters the slit 163 formed between the leading edge of the bottom wall 162 and the vertical wall 165 and is grasped between the rings 185 and 186 of the transport wheels 137 and the idler wheels 174, respectively.

Figure 13:
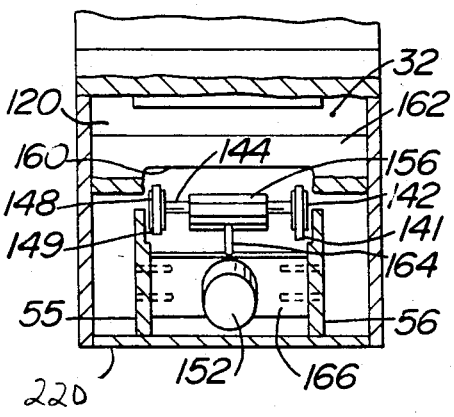

The pintle 154 for the plate 156 is supported at its opposite ends by the walls 55 and 56. The weight of the plate 156 about the pintle 154 is such as to bias it clockwise (FIG. 6) away from the slot 160 but if desired a coil spring (not shown) could be added to the pintle 154 to further bias the plate 156 away from the slot 160. The plate 156 also carries a stop leg 164 which abuts against the solenoid 152 to limit clockwise (FIG. 2) rotation of the plate 156. Also, the solenoid 152 is secured to a bridge plate 166 which is in turn secured to the walls 55 and 56, as shown in FIG. 13.

The shaft 103 extends beyond the wall 55 sufficiently to rotatably carry a further pulley 130 about which is a belt 131 for rotating a pulley 133 mounted on a shaft 135, the latter being rotatably carried by the walls 55 and 56. The shaft 135 also carries four of the transport wheels 137 (FIGS. 5, 7 and 14) spaced along the shaft 135, as shown, to transport the card ejected from the storage compartment 32 to the dispensing compartment 37. Above the transport wheels 137 is a spring loaded idler assembly 170 comprising a block 172 at opposite ends of which are rotatably carried two of the idler wheels 174 on a shaft 175 engaging with two of the transport wheels 137, as shown in FIG. 14, to receive a card therebetween when the card is ejected from the storage compartment 32 to help propel it to the dispensing compartment 37.

Figure 14:
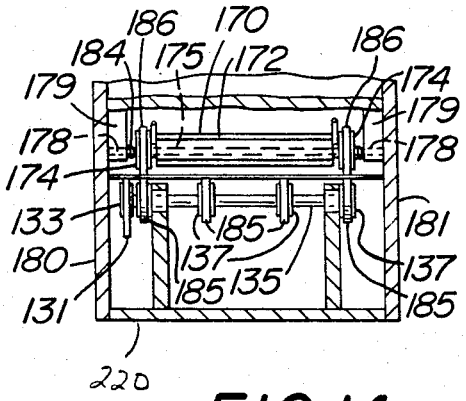

The block 172 is itself pivotally supported on two shafts 178 which are received in two blocks 179 suitably secured to the outer front wall 180 and the outer rear wa11 181, as shown in FIG. 14. Suitable coil springs 184 bias the block 172 downwardly toward the transport wheels 137.

The two idler wheels 86, FIG. 10, which cooperate with the transport belts 109 and 114 are mounted on and rotatable with a shaft 122. The shaft 122 is in turn journaled in a block 124 which is received in and keyed to a suitable groove in the bottom wall 98, FIG. 6, of the well 16. The weight of the block 124 is sufficient to bias the wheels 86 against the belts 109 and 114, but if desired a bias spring could be added.

Likewise, the two idler wheels 88, FIG. 12, which also cooperate with the transport belts 109 and 114, are mounted on and rotatable on shaft 126 which is carried by a block 127. As seen in FIGS. 6 and 12, the block 127 is pivotally mounted on ears 128 by pins 129 one of which carries a coil spring 132 to bias down the block 127, and, hence, the wheels 88 against the transport belts 109 and 114. The ears 128 are secured to the walls 180 and 181, see FIG. 12. In FIG. 12, one card is shown between the idler wheels 88 and the transport belts 109 and 114, the card being guided at its left and right hand edges, by the inside surfaces of the walls 180 and 181.

To facilitate the ejection of the cards, it is preferred that the top surfaces of the bottom walls 74, 98 and 162 all slope down, as shown, at an angle with the horizontal of about 15°. Further, to better control the entry and deposit of the cards into the compartment 32, a wedge 188 is placed adjacent to the slit 95, as shown in FIG. 6, the wedge being carried by a cover 194.

The wells 14 and 16 have open tops, as shown, but for card security, a door 190 may be provided to cover at least part of the open tops, as shown in FIG. 1. The door 190 may be suitably hinged to the back wall 181 as shown by the dotted hinge pins 192 in FIG. 1.

Similarly, the compartment 32 which has an open top may also be provided with the cover 194 hinged to the front wall 180 and the back wall 181 as shown by the dotted hinged pin 196 in FIG. 1.

To facilitate placement or removal of the cards into the wells 14 and 16 and the compartment 32, the front wall 180 is provided with elongated slots 200, 202 and 204, respectively, as shown in FIG. 1.

As best shown in FIG. 7, the various belts may be provided with tightening idlers such as the idler 210 for the belt 131 and suitably mounted on the wall 55, the idler 212 for the belt 141 and suitably mounted on the wall 56, the idler 214 for the belt 80 and also suitably mounted on the wall 56, the idler 216 for the belt 101 and also suitably mounted on the wall 56.

Also, the various belts and rings may be made of various plastic or rubber materials. It is, of course, important that the belts and the rings provide enough friction with the cards to properly move them.

Further, the various belts and rings might be replaced by gears without departing from the scope of this invention.

Instead of providing one motor driving the various belts and wheels as is here shown and described, it would also be possible to substitute individual motors for the individual extraction of cards at each of the wells and the storage compartment.

For the bottommost cards to be properly extracted from the wells 14 and 16 and the storage compartment 32 there must be a sufficient downward pressure against the various belts and rings and sufficient frictional engagement. It has been found that this sufficient downward pressure is developed when there is a minimum of about 52 cards in each well 14 and 16 or storage compartment 32. The material of the belts and rings is chosen so that a sufficient frictional engagement with the cards will result. Spring means could be also provided, but are not shown, to bias the stacks of cards downwardly against the belts and rings.

The inside opposed surfaces of the vertical walls 180 and 181, as seen for example in FIG. 14, guide the cards as they travel to the dispensing compartment 37 and when they are taken therefrom. The cards are placed in the wells 14 and 16 so that their lengths are at right angles to the path of travel of the cards from the wells 14 and 16 to the dispensing compartment 37.

The vertical walls 180 and 181 are secured to a suitable base 220 (by means not shown) and likewise the top and sides are closed by suitable plates 222.

In operation, the automatic card shuffler of the present invention is utilized to provide one card at a time to dispensing compartment 37 to be used by the card dealer.

The automatic card shuffler sequentially randomly selects cards from the first or front well 16 and the rear or second well 14 when cards are present in both wells. A predetermined number of cards, preferably approximately 52, is maintained in storage compartment 32 from either well 16 or wells 14 and 16.

In the preferred method of operation, a predetermined number of pre-shuffled cards is placed in the front or first well 16. This predetermined number of cards may be selected to be six decks, each of 52 cards, although any other suitable number may be chosen. When the machine is turned on, a predetermined number of cards are immediately, during a period of about 2.2 seconds, transferred from the first well 16 into the storage compartment 32. This predetermined number of cards is approximately 52 cards. The cards from the storage compartment 32 are then sequentially made available to the dispensing compartment 37 in sequence, one at a time. In other words, as a card is removed from the dispensing compartment 37 by the card dealer, a card is immediately extracted from the bottom of the storage compartment 32 and transported to the dispensing compartment 37.

After a number of cards have been played and no longer form a part of the active game, sometimes referred to as "dead" cards, these cards are collected and placed into the rear or second well 14. A sensor 252 detects the presence of a predetermined number of cards in the well 14. The detection of cards in the well 14 enables a random signal generator to sequentially, randomly energize the solenoids 68 and 90 for extracting a card from either the well 14 or the well 16, which extracted card is then transported to the storage compartment 32. As previously described, the bottom card in the storage compartment 32 is transported to the dispensing compartment 37 in response to the removal of a card from the dispensing compartment 37 by the card dealer. Removal of the card from the dispensing compartment 37 by the card dealer is detected by a photosensor 250, which is preferably a microphotosensor.

Referring to FIG. 15, there is shown a block diagram of the preferred embodiment of the electronic controller 65 for controlling the operation of the solenoids 68, 90 and 152. The controller 65 includes a clock circuit 254 which may preferably generate a 1 kilohertz pulse signal. However, it should be understood throughout the description herein that specific values may be given in illustrating the preferred mode of practicing the invention, but it is understood that such values such as frequencies, signal times and other values are not intended to be limiting and that other appropriate values may be utilized in practicing the present invention. The clock signal output of the clock circuit 254 is fed to a random signal generator and control circuit 256. The random signal generator and control circuit 256 provides an output on either line 258 or line 260. The output on line 258 energizes solenoid 68 to actuate the means for extracting a card from the bottom of the rear or second well 14. The output on line 260 energizes the solenoid 90 which actuates the means for extracting a card from the bottom of the front or first well 16. When the "on-off" switch 262 is switched from the "off" condition to the "on" condition, the initial load timer circuit 264 is activated to generate a control signal output via the line 266 to the random signal generator and control circuit 256. This signal output of the initial load circuit 264 via the line 266 is of a predetermined duration, which may preferably, in a preferred embodiment be 2.2 seconds or sufficient time to load approximately 52 cards from the well 16 into the storage compartment 32. In other words, the output on the line 266 causes random signal generator and control circuit 256 to provide an output on the line 260 to energize the solenoid 90 to cause the belt 80 and the ring 85 to remain raised in a position to contact the bottommost cards for the extraction of a predetermined number of cards from the well 16, preferably approximately 52. Once the initial loading of the storage compartment 32 from well 16 is complete, the initial load timer circuit 264 locks itself in a condition where the output is not provided on the line 266.

As may be seen in FIGS. 2 and 6, a dispensing compartment 37 is provided with a photosensor 250, which may preferably be a microphotosensor, for detecting the presence or absence of a card in the dispensing compartment 37. When the photosensor 250 detects the absence of a card in the dispensing compartment 37, a signal is transmitted via the line 268 to timer circuit 270 which then causes the energization of the solenoid 158 which in turn causes the extraction of a card from the bottom of the storage compartment 32, the card being then transported to the dispensing compartment 37. In this manner, as soon as a card is removed from dispensing compartment 37, a new card from the storage compartment 32 is replaced therein. The timer circuit 270 also provides an output, when it energizes the solenoid 152, to the random signal generator and control circuit 256, via the line 272.

In response to a signal on the line 272 and a signal on the line 274 from the photosensor 252, random signal generator and control circuit 256 will energize either solenoid 68 or solenoid 90 to cause the extraction of a card from either well 14 or well 16, respectively, in a random manner. The random signal generator and control circuit 256 may successively energize the solenoids 68 and 90 alternately so as to successively extract cards from the wells 14 and 16 alternately or it may energize only one of the solenoids 68 or 90 successively, a number of times before energizing the other solenoid, for example, it may energize the solenoid 90 successively three times so as to extract three successive cards from well 16 before the solenoid 68 is energized and before any card is taken from well 14. In any event, the so extracted card is then transported to the storage compartment 32. A signal is present on the line 274 to enable the random signal generator and control circuit 256 only when photosensor 252 detects the presence of a predetermined number of cards in well 14.

Referring now to FIG. 16, there is shown a preferred embodiment of specific circuitry which may be utilized to provide the control circuitry as set forth in FIG. 15. However, it will be apparent to those skilled in the art that various changes and modifications may be made and that the same functional results may be achieved by the utilization of various other electronic components and assemblies. Like components in FIG. 16 are given like numerals as in the previous figures and in the description thereof. During the initial loading of cards from the well 16 into the storage compartment 32, the operation is substantially as follows. With "on/off" switch 262 in the "off" position, a flip flop circuit 276 is held in a reset condition by the application of ground to its reset terminal. After the initial six decks are placed in the well 16, "on/off" switch 262 is placed in the "on" position activating an initial load timer 278. The initial load timer 278 and the other timer circuits referred to herein may be monostable multivibrators or other suitable pulse generator circuits which generage a pulse output of a selected duration in response to being triggered. The output of the initial load timer 278 is indicated as dwell F and has an output of a duration preselected to be sufficient to load approximately 52 cards into the storage compartment 32 from the well 16. The output of the intiial load timer 278 is fed to an OR gate 280. The output of OR gate 280 is fed into an AND gate 282 which activates an "on" dwell timer 284, the output of which operates a solenoid driver circuit 286 and the solenoid 90. The solenoid 90 is energized for approximately 2.2 seconds which is the time selected to extract by belt 80 and ring 85, as previously described, approximately 52 cards from the well 16 for transport to the storage compartment 32 and this time is determined by dwell F.

The output of the initial load timer 278 is also fed through an inverter 288, the output of which inhibits an "on" dwell timer 290 which provides the output to a solenoid driver 292 to energize the solenoid 152. The solenoid 152 is thereby precluded from being energized during this period of time, and therefore, cards are not transported from the storage compartment 32 to the dispensing compartment 37.

The trailing edge of the dwell time signal F causes the triggering of a one shot multivibrator 294, the output of which resets the flip flop circuit 276, thereby disabling the initial load timer 278 from being re-triggered unless the system is again turned "off" thereby eliminating the possibility of loading an additional 52 cards into the storage compartment 32. Additionally, when the dwell time signal F expires, it releases the inhibit signal from the "on" dwell timer 290, thereby enabling the subsequent energization of the solenoid 152.

Upon the photosensor 250 sensing that there is no card present in the dispensing compartment 37, the signal output of photosensor 250 is applied through an inverter 296 and an AND gate 298, upon the occurrence of a clock signal and the absence of an "off" dwell time signal from an "off" dwell timer 300, to trigger the "on" dwell timer 290 to cause the energization of the solenoid 152 through the solenoid driver 292, thereby causing the extraction of a card from the bottom of the storage compartment 32 and delivery of it to the dispensing compartment 37. The "on" dwell timer 290 activates the solenoid 152 through the solenoid driver 292, just long enough to extract one card from the bottom of the storage compartment 32. The trailing edge of the output of the "on" dwell timer 290 triggers an "off" dwell timer 300 which prevents the dwell timer 290, from being triggered again by inhibiting the input to the AND gate 298 through a further inverter 302, to allow sufficient time for the card extracted from the storage compartment 32 to be transported to the dispensing compartment 37 before the output of the photosensor 250 is again able to trigger the "on" dwell timer 290.

The operation of the circuit during normal play with the cards in the front well 16 and before the placing of the cards in the rear well 14 is as follows. Each time the dealer extracts a card from the dispensing compartment 37, the photosensor 250 senses the absence of a card and produces a signal through the inverter 296, which passes through the AND gate 298, upon the concurrence of an appropriate clock signal from the clock 254 and an appropriate output from the inverter 302, to trigger the "on" dwell timer 290, which activates the solenoid 152, through the solenoid driver 292, for a period sufficient to extract one card from the storage compartment 32 for transport to the dispensing compartment 37. Upon expiration of the output signal of the "on" dwell timer 290, the "off" dwell timer 300 is activated, which inhibits the "on" dwell timer 290 via the AND gate 298. When the "off" dwell timer 300 expires, the trailing edge of the signal triggers the one shot multivibrator 304, the output of which is applied to the OR gate 280 and an AND gate 306. During this operation, a decoder 308 is inhibited by the output of an AND gate 312 due to the absence of the detection of cards in the well 14 by the photosensor 252. The signal from the one shot multivibrator 304 is fed through the OR gate 280 and the AND gate 282 to activate the "on" dwell timer 284. The output of the "on" dwell timer 284 activates the solenoid 90 via the solenoid driver 286. The duration output of the "on" dwell timer 284 is preselected to be of sufficient duration to extract one card from the bottom of the front or first well 16. Therefore, this process is repeated each time a dealer removes a card from the dispensing compartment 37, with the result that as a card is extracted from the bottom of the storage compartment 32 and transported to the dispensing compartment 37, a card is also extracted from the bottom of the well 16 and transported to the storage compartment 32.

The operation of the circuit as the play continues, with the replacement of sufficient cards into the rear or second well 14 so that the sufficient cards are sensed by the photosensor 252, is that the output of the photosensor 252 is now high. This signal is fed through an AND gate 312, since the output of the inverter 288 is high at this time, due to the control of the flip flop 276 on the initial load timer 278. The output of the AND gate 312 now releases the inhibit signal from the decoder 308 and the clock signal output of the clock 254 is then applied to the counter 310. The output of counter 310 is applied to decoder 308 and the counter 310/decoder 308 circuitry is free running in response to the clock signal. Selected outputs of decoder 308 are applied to AND gates 316 and 318. The AND gates 316 and 318 have inverted outputs and optionally may be described as NAND gates. In practice, decoder 308 may be a 4 to 16 bit decoder with a preselected eight of its 16 outputs connected to the input of AND gates 316 and 318. However, it is understood that other decoder circuits may be utilized and that more or less inputs may be utilized. The outputs of AND gates 316 and 318 are applied to the input of OR gate 320. The output of OR gate 320 is applied as one input of AND gate 306 and is applied through inverter 321 as an input to AND gate 282. Therefore, for any particular output of OR gate 320, an enabling input or high signal will be applied to only one of the AND gates 306 and 282.

Each time a card is removed from the dispensing compartment 37, timers 290 and 300 are operated as previously described. When the signal from "off" dwell timer 300 expires, its trailing edge triggers the one shot multivibrator 304, the output of which is fed to OR gate 280 and AND gate 306. The clock signal is fed through the inverter 314 and is applied to AND gates 306 and 282. At random, the combination of the output of the one shot multivibrator 304 and the output of the decoder 308 (processed through the AND gates 316 and 318, the OR gate 320 and the inverter 321) determines whether the output of the one shot multivibrator 304 will pass through the AND gate 282 or 306. If the signal passes through the AND gate 306, the "on" dwell timer 322 is triggered causing the activation of the solenoid 68, through the solenoid driver 324, for a sufficient period of time to extract one card from the rear or second well 14. If the signal passes through the AND gate 282, the "on" dwell timer 284 will be activated which in turn will activate the solenoid 90 causing the extraction of a card from the first or front well 16. Of course, it is obvious that various modifications may be made to this circuitry. For example, the timer output may be selected to select more than one card at a time from the wells. It will be apparent to those skilled in the art that various other circuits may be utilized to achieve the same or similar operation.

In view of the above, the present invention may be embodied in other specific forms without departing from the spirit or essential attributes thereof and, accordingly, reference should be made to the appended claims, rather than to the foregoing specification as indicating the scope of the invention.

Having described the invention, what I claim is:

1. An automatic shuffling device for playing cards comprising a housing defining at least two wells for receiving two stacks of playing cards, a first electrically operated means to extract cards from said wells, and an electrical controller to randomly actuate said first electrically operated means so as to randomly select cards from the wells and thereby randomly intermix the cards as they are extracted from said wells.

2. The combination of claim 1 and further including transport means to receive said extracted cards from said wells.

3. The combination of claim 2 wherein said housing further defines a storage compartment to receive intermixed cards from said wells, and further including second electrically operated means to extract cards from said storage compartment one at a time.

4. The combination of claim 1 wherein said housing further defines a storage compartment to receive intermixed cards from said wells, and further including second electrically operated means to extract cards from said storage compartment one at a time.

5. The combination of claim 4 wherein said housing also defines a dispensing compartment to receive one card at a time from said storage compartment.

6. An automatic shufflin in accordance with claim 1, 2, 4, or 5 or 3 wherein said electrical controller includes random signal generator for randomly selecting the extraction of cards from said two wells.

7. An automatic shuffling device for playing cards in accordance with claim 6 wherein said random signal generator means includes
- a clock means for generating a clock pulse signal,
- a counter means for counting pulses of said clock pulse signal,
- a decoder circuit means for providing a decoder output in response to said counter output,
- a means for selecting an output in response to selected decoder outputs,
- a means for randomly gating the selected output to one of said first and second extracting means to randomly select cards from one of said first and second wells.

8. An automatic shuffling device for playing cards comprising
- a first well for receiving cards,
- a second well for receiving cards,
- a storage compartment for receiving cards from said wells,
- a first means for extracting a predetermined number of cards from said first well and transporting the extracted card or cards to said storage compartment,
- a second means for extracting a predetermined number of cards from said second well and transporting the extracted card or cards to said storage compartment,
- random signal generator means for operating said first and second extracting means in a random sequence for randomly loading cards into said storage compartment, and
- means for delivering cards from said storage compartment to a dealer.

9. An automatic shuffling device for playing cards in accordance with claim 8 wherein said random signal generator means includes
- a clock means for generating a clock pulse signal,
- a counter means for counting pulses of said clock pulse signal
- a decoder circuit means for providing a decoder output in response to said counter output,
- a means for selecting an output in response to selected decoder outputs,
- a means for randomly gating the selected output to one of said first and second extracting means to randomly select cards from one of said first and second wells.

10. An automatic shuffling device for playing cards in accordance with claim 8 wherein said means for delivering cards from said storage compartment to a dealer includes
- a dispensing compartment,
- a sensing means for sensing the presence of a card in said dispensing compartment, and
- a third means for extracting a card from said storage compartment and delivering it to said dispensing compartment in response to a signal output from said sensing means.

11. An automatic shuffling device for playing cards, comprising
- a first well for receiving cards,
- a second well for receiving cards,
- a storage compartment for receiving cards from said first and second wells,
- a dispensing compartment for receiving one card at a time from said storage compartment,
- a first means for extracting a predetermined number of cards from said first well and transporting the extracted card or cards to said storage compartment,
- a second means for extracting a predetermined number of cards from said second well and transporting the extracted card or cards to said storage compartment,
- a third means for extracting a card from said storage compartment and delivering it to said dispensing compartment,
- a first means for sensing the presence of a card in said dispensing compartment,
- a second means for sensing the presence of a predetermined number of cards in said second well,
- an initial load timer circuit means for operation of said first extraction means to load a predetermined number of cards from said first well into said storage compartment,
- a random signal generator means operable in response to the output of said second sensing means for randomly sequencing the operation of said first and second extracting means to randomly load cards into said storage compartment, and
- a circuit means responsive to the output of said first sensing means for operating said third extracting means to transfer one card at a time to said dispensing compartment.

12. An automatic shuffling decice for playing cards in accordance with claim 11 wherein said random signal generator includes
- a clock means for generating a clock pulse signal,
- a counter means for counting pulses of said clock pulse signal,
- a decoder circuit means for providing a decoder output in response to said counter output,
- a means for selecting an output in response to selected decoder outputs,
- a means for randomly gating the selected output to one of said first and second extracting means to randomly select cards from one of said first and second wells.

13. An automatic shuffling device for playing cards in accordance with claim 12 wherein a signal is derived for randomly gating the selected output of one of said first and second extracting means from the output of said first means for sensing the presence of a card in said dispensing compartment.

14. An automatic shuffling device for playing cards in accordance with claim 12 wherein said means for selecting an output in response to selected decoder outputs includes gating circuitry comprised of AND gates and OR gates, with the inputs of said AND gates being derived from selected outputs of said decoder circuit and the outputs of said AND gates being fed to an OR gate.

15. An automatic shuffling device for playing cards in accordance with claim 12 wherein said first and second extracting means include solenoids which are operated by randomly gated selected output.

16. An automatic shuffling device for playing cards in accordance with claim 11 wherein said first means for sensing the presence of a card comprises a photosensor.

17. An automatic shuffling device for playing cards in accordance with claim 11 wherein said second means for sensing the presence of a predetermined number of cards in said second well comprises a photosensor.

18. An automatic shuffling device for playing cards comprising wall means defining a first well for a first stack of cards and a second well for a second stack of cards, a first continuously operated electro-mechanical means movable from a first position out of engagement with the bottommost card in said first well to a second position in engagement therewith for extraction thereof, a second continuously operated electro-mechanical means movable from a first position out of engagement with the bottommost card in said second well to a second position in engagement therewith for extraction thereof.

said first and second electro-mechanical means being disposed below said wells, said wall means also defining openings through which said first and second electro-mechanical means may engage the bottommost cards in the two stacks of cards for extraction thereof, and an electrical controller to randomly signal said first and second electro-mechanical means for movement into and out of engagement with the bottommost cards of the two stacks of cards so as to randomly extract and intermix the cards.

19. The combination of claim 18 wherein said first and second electro-mechanical means each include a rotating belt driving a pulley, a shaft rotated by said pulley, a frictional wheel mounted on said shaft and spaced from said belt, said belt and frictional wheel being engageable with the bottommost card in the stack, motive power means for rotating said belt, pulley, shaft and frictional wheel, a linkage mechanism connected to said shaft for raising said shaft so as to bring said belt and frictional wheel into engagement with the bottommost card, and electrically operated means for randomly activating said linkage mechanism in response to a signal from said electrical controller.

20. The combination of claim 19 wherein said electrically operated means is a solenoid.

21. The combination of claim 18 and further including further wall means defining a storage compartment for receiving the intermixed cards from said first and second wells, continuously operated transport means for delivering the cards to said storage compartment, a third continuously operated electro-mechanical means for extracting cards from said storage compartment, said third electro-mechanical means being disposed below said storage compartment, said further wall means also defining an opening through which the cards may exit said storage compartment, said further wall means defining an opening through which said third electro-mechanical means may engage the bottommost card in said storage compartment for extraction thereof, said electrical controller signalling said third electro-mechanical means into engagement with the bottommost card in the storage compartment to extract one card at a time therefrom.

22. The combination of claim 21 and further including a dispensing compartment to receive one card at a time from said storage compartment, sensing means to determine when a card is absent from said dispensing compartment so as to signal said electrical controller to actuate said electro-mechanical means, and further sensing means in at least one of said wells to determine the presence of a predetermined number of cards.

23. An automatic shuffling device for playing cards comprising wall means defining a first well for a first stack of cards and a second well for a second stack of cards, a first continuously operated electro-mechanical means randomly movable from a first position out of engagement with the bottommost card in said first well to a second position in engagement therewith for extraction thereof, a second continuously operated electro-mechanical means randomly movable from a first position out of engagement with the bottommost card in said second well to a second position in engagement therewith for extraction thereof, said first and second electro-mechanical means being disposed below said wells, and said wall means also defining openings through which said first and second electro-mechanical means may engage the bottommost cards in the two stacks of cards for extraction thereof.

* * * * *